US005588190A

United States Patent [19]

Sato

[11] Patent Number: 5,588,190

[45] Date of Patent: Dec. 31, 1996

[54] ACCESSORIES

[75] Inventor: Takashi Sato, Chiba, Japan

[73] Assignee: Murao Co., Ltd., Chiba, Japan

[21] Appl. No.: 497,395

[22] Filed: Jun. 30, 1995

[51] Int. Cl.[6] ..... A44C 11/00; A44B 21/00

[52] U.S. Cl. ..... 24/682.1; 24/116 A; 24/135 N; 24/616

[58] Field of Search ..... 24/682.1, 687, 24/688, 689, 70 J, 68 J, 69 J, 71 J, 265 WS, 116 A, 135 N, 616

[56] References Cited

U.S. PATENT DOCUMENTS

| | | | |
|---|---|---|---|
| 1,855,116 | 4/1932 | Prajer | 24/135 N |
| 2,148,004 | 2/1939 | Yagich | 24/135 N |
| 4,342,477 | 8/1982 | McClure | 24/135 N |
| 4,883,007 | 11/1989 | Nagasaka | 24/135 N |
| 4,907,322 | 3/1990 | Kanno | 24/116 A |
| 5,317,789 | 6/1994 | Levy | 24/616 |
| 5,398,391 | 3/1995 | Yokochi | 24/682.1 |

FOREIGN PATENT DOCUMENTS

| | | | |
|---|---|---|---|
| 0193923 | 3/1923 | United Kingdom | 24/135 N |

*Primary Examiner*—Victor N. Sakran

*Attorney, Agent, or Firm*—Cushman Darby & Cushman IP Group of Pillsbury Madison & Sutro LLP

[57] ABSTRACT

This invention provides an accessories which can be fixed by merely inserting a fixing pin into a wire string fastener. According to this invention, a series of decorative bodies are coupled one after another by means of a wire string, each end of the wire string is passed through a through-passage formed in a wire string fastener and through a turn-back portion of clasp, the end of the wire string thus passed through is then turned back to be again passed through the through-passage where the each end of the wire string is fixed by means of a fixing means. The wire string fastener is provided with a fastening hole and a depression. A fixing pin is fittingly inserted into the fastening hole, and provided with a projected portion extending slightly larger than the inner diameter of the fastening hole to contact with the vicinity of the opening of the fastening hole. The wire string is fixed in a bent manner along the depression by the pressing portion of the fixing pin.

8 Claims, 8 Drawing Sheets

ACCESSORIES

BACKGROUND OF THE INVENTION a. Field of the Invention

This invention relates to an accessories comprising a series of decorative bodies coupled one after another by means of a wire string pierced through the series of decorative bodies, a pair of wire string fasteners, each disposed near the end of the wire string, and a clasp provided with string-passing rings engaging respectively with both ends of the wire string;

each end portion of the wire string passing through a through-passage formed in the wire string fastener and through the string-passing rings of the clasp, turning back from the string-passing rings, passing again through said through-passage, and then being fastened by a fastening means attached to the wire string fasteners.

b. Description of the Prior Art

There is known, as accessories of this kind, a structure as proposed for example in Japanese Utility Model Unexamined Publication No. H1-41311.

According to this known accessories, the through-passage formed in a wire string fastener is provided with threads, and the end portion of wire string turned back from a clasp is fastened by the pressing power of the tip portion of a screw engaging with the threads.

However, since the end portion of wire string is releasably fastened by the combination of a tapped hole and a fastening screw according to this known construction, the structure is required to be releasably fastened, thus causing the fastening structure as well as the wire string fastener to become large in size as a whole.

On the other hand, as another structure for fastening both end portions of a wire string, each being turned back from a clasp, Japanese Utility Model Publication No. S57-60340 discloses a gobang string-fastening structure for an accessories. However, according to this structure, a wire string is first inserted into a fastening pipe to be subsequently caulked, and, after caulking the fastening pipe, the caulked pipe is further inserted into a covering pipe, thereby making the structure rather complicated.

There is known another structure wherein twofold of wire string is inserted into a wire string fastener as proposed in Japanese Utility Model Unexamined Publication No. S59-23316. According to this structure, the hole inserting a wire string therein is collapsed or filled with a filler so as to fasten the end portions of the wire string. However, this structure is defective in that the wire string fastener may become undesirably deformed and the fastening work is rather troublesome.

SUMMARY OF THE INVENTION

The present invention has been accomplished in view of above circumstances, and therefore, the main object of the present invention is to provide accessories wherein a wire string can be easily fastened to a wire string fastener by simply inserting a fixing pin into a securing hole of the wire string fastener.

Another object of this invention is to provide accessories which are capable of simplifying the fastening operation of a wire string to a wire string fastener.

This object has been achieved according to the present invention by providing a technical means which comprises;

(a) an accessories comprising a series of decorative bodies coupled one after another by means of a wire string pierced through the series of decorative bodies, a pair of wire string fasteners, each disposed near the end of the wire string, and a clasp provided with string-passing rings engaging respectively with both ends of the wire string;

each end portion of the wire string passing through a through-passage formed in the wire string fastener and through the string-passing rings of the clasp, turning back from the string-passing rings, passing again through said through-passage, and then being fastened by a fastening means attached to the wire string fasteners; wherein (b) each of said wire string fasteners is provided with a fastening hole, one end of which being communicated with said through-passage and the other end of which being open to outside;

(c) said fastening means is formed of fixing pin which can be fittingly inserted into said fastening hole;

(d) said fixing pin is provided on its peripheral wall portion with a projected portion extending slightly larger than the inner diameter of said fastening hole, said projected portion being disposed at a portion of said peripheral wall portion which is kept positioned within said fastening hole as said wire string is press-held by a tip portion of said fixing pin.

In place of the above construction, (d) said fixing pin may be provided with a projected portion in such a manner that it extends slightly larger than the inner diameter of said fastening hole, it is inserted near the opening of said fastening hole when the tip portion of said fixing pin is not yet introduced into said through-passage, and it is kept remained within said fastening hole as said wire string is press-held by a tip portion of said fixing pin.

In place of the above construction, (e) a depression is formed at a portion of inner wall of said through-passage which corresponds to an extension of said fastening hole, and said fixing pin is provided at its tip portion with a pressing portion of a size that can be fitted into an opening of said depression, thereby allowing said wire string to be fastened between said depression and said tip portion of fixing pin in such a manner that said wire string is bent in conformity with a shape of said depression.

According to this invention, it is desired that said projected portion of the fixing pin is coaxial with and larger in diameter than other portion of the fixing pin. It may be further desirable to make the tip portion of the fixing pin into a taper so as to allow the fixing pin to be easily inserted into the fastening hole.

In this invention, the wire string may be a wire per se or a wire covered with a coating material such as polyvinyl and the like.

Since the fixing pin to be fitted into the fastening hole is provided with a projection slightly larger than the size of the fastening hole, and is adapted to be fitted into the fastening hole with the projection being strongly pressed on the inner wall and being partially collapsed, a small space that may be formed between the fastening hole and the fixing pin may be completely buried thus forming a wedge therein and thus strengthening the sticking power between the fastening hole and the fixing pin.

Moreover, when a depression is formed as mentioned above, the wire string can be effectively pressed into the depression by the tip portion of the fixing pin, so that the wire string can be fastened between the depression and the tip portion of fixing pin, the wire string being bent in conformity with a shape of said depression.

With this structure, it is possible to increase the tensile strength of the wire string even if the press-contacting surface thereof with the fixing pin is rather small.

As explained above, since the wire string can be firmly fastened even if the fixing pin is thin, it is possible to minimize the size of the wire string fastener. Further, it is possible to fasten the wire string through a simple operation of inserting the fixing pin into the fastening hole.

Further, since the projected portion of the fixing pin can be kept disposed near the opening of said fastening hole without causing the tip portion of said fixing pin to be introduced into said through-passage at the occasion of inserting the fixing pin into the fastening hole, it is possible to pass the wire string through the through-passage of the wire string fastener while preliminarily attaching the fixing pin to the wire string fastener.

When the wire string is to be fastened, the fixing pin is pushed into the through-passage of the wire string fastener thereby causing the wire string to be pressed into the depression of the wire string fastener. In this case, since the projection of the fixing pin is pressed and partially collapsed by the inner wall of the fastening hole as it is advancing through the fastening hole, and kept therein under such a condition, the fixing pin can be firmly locked therein.

This locking strength can be adjusted by selecting the magnitude (diameter) and length of the projection.

DETAILED DESCRIPTION OF THE PREFERRED EMBODIMENT

In the followings, a preferred embodiment of accessories according to this invention will be explained with reference to drawings.

Figure 1:
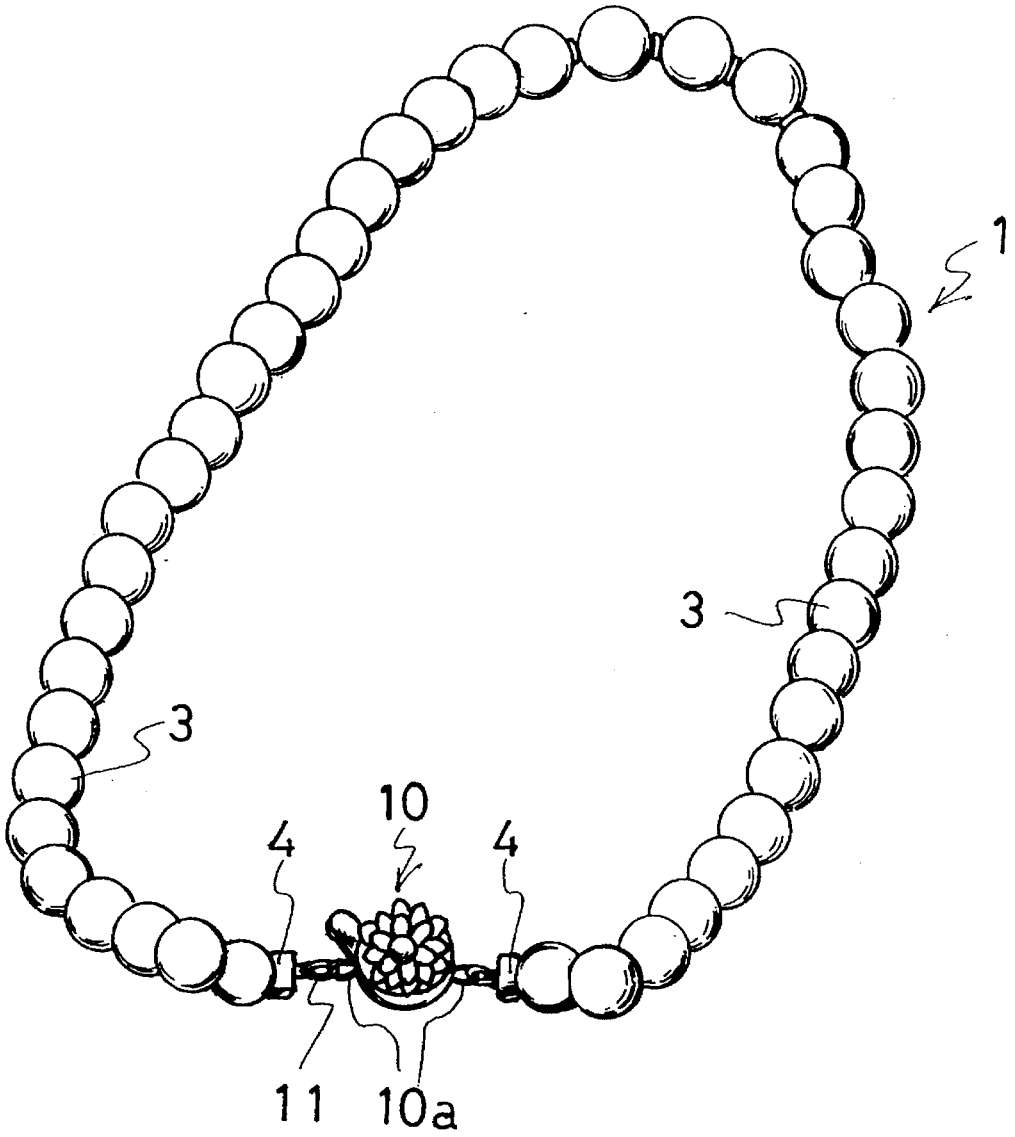
FIG. 1 depicts a perspective view of accessories according to the present invention.
Figure 2:
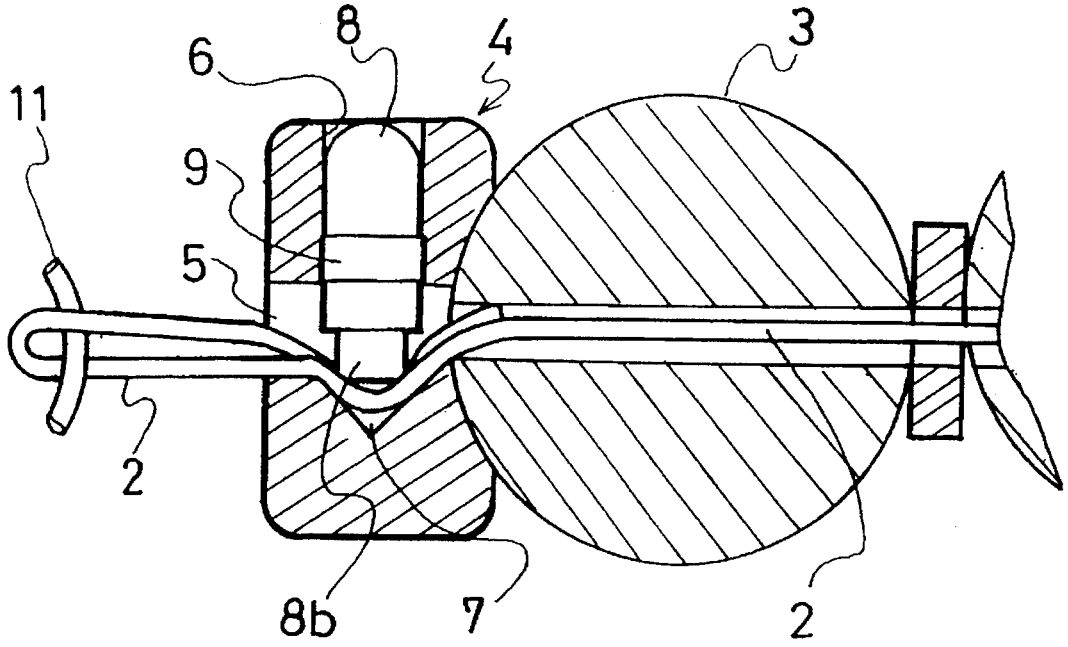
FIG. 2 is a sectional view showing mainly of a wire string fastener.

Referring to FIGS. 1 and 2, the accessories 1 comprises a clasp 10 as a hooking means. A wire string 2 is pierced through the series of decorative bodies 3, and each end portion of wire string 2 is passed through a through-passage 5 formed in the wire string fastener 4. Each end portion of the wire string 2 is then turned back from the clasp 10 and passed again into the through-passage 5 from the opposite direction. This wire string 2 thus doubly introduced into the through-passage 5 is fastened by inserting a fixing pin 8 into a fastening hole 6 of the wire string fastener 4.

In this example, the wire string 2 is of conventional type and comprises a stainless wire as a core material, and a covering material made of a pliable synthetic resin (for example, a polyvinyl cover) coating over the core material.

The decorative bodies 3 are formed for example of beads such as pearls, and many a number of them are connected to each other through the wire string 2 as shown in FIG. 1.

The clasp 10 comprises, as conventionally known, a pair of pieces detachably connected to each other, each piece being attached with a ring 10*a* to which one or more of string-passing rings 11 are connected.

In this example, this string-passing rings 11 functions as a hook means for allowing the wire string to turn back. However, this hook means may be omitted by replacing it with the ring 10*a* which is internally formed with the clasp 10.

Figure 3A:
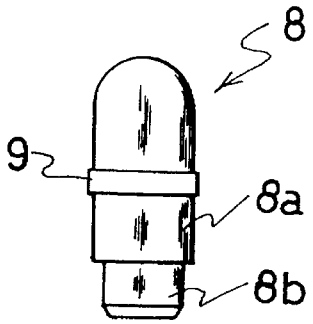
FIG. 3 shows a fixing pin and a wire string fastener; wherein (a) illustrates a fixing pin according to the first example of this invention; (b) a side view of a fixing pin according to the second example of this invention; and (c) a wire string fastener that can be used in common to (a) and (b)
Figure 3B:
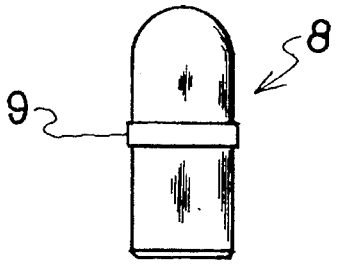
Figure 3C:
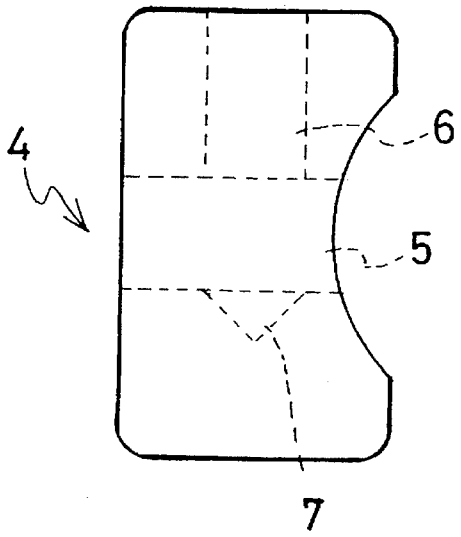

The wire string fastener 4 is formed of a metallic material, and is provided with the through-passage 5 passing through the central portion thereof and with a fastening hole 6 communicating in perpendicular with the through-passage 5 and opening to outside at one end as shown in FIGS. 2 and 3(*c*).

The wire string fastener 4 is constructed such that its one side wall facing to the beads is spherically depressed.

The through passage 5 is circular in cross-section and has a sufficient inner diameter to allow dual wire strings formed by the turn-back of the wire string 2 to be inserted therein.

The fastening hole 6 is circular in cross-section and formed in perpendicular to the through-passage 5.

A depression 7 is formed on a portion of the inner wall of the through-passage 5 which coincides with the extended direction of the fastening hole 6. This depression 7 is V-shaped in cross-section, or at least the bottom portion of the depression 7 is V-shaped in cross-section, so as allow a portion of the wire string 2 passing thereover to be bent in the direction of the extension of the fastening hole 6.

In the embodiment shown in this Fig., the shape of the depression 7 is of cone-shape, which can be easily formed by the tip portion of a drill.

However, the shape of the depression 7 is not limited to this embodiment, but may be U-shape or any other shapes as long as it is capable of bending the wire string 2 when it is pressed by a fixing pin 8.

Figure 4:
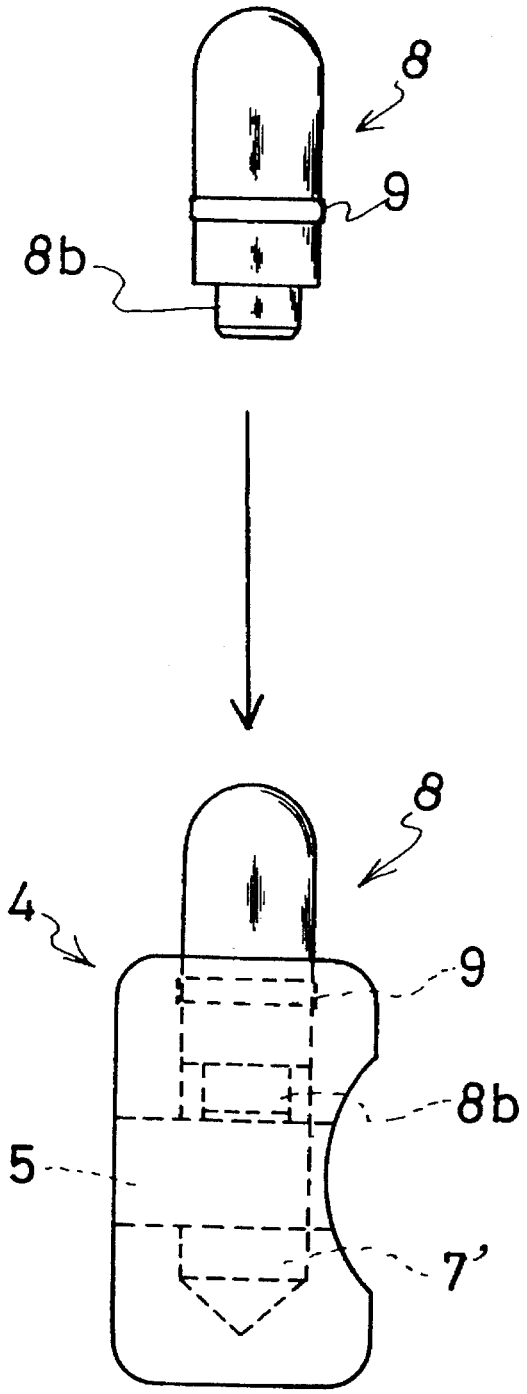
FIG. 4 is a side view of a wire string fastener of another example showing a modified shape of depression.

The depression 7 shown in FIG. 4 is shaped such that the main portion thereof is of the same shape as that of the fastening hole 6, and the tip portion thereof is V-shaped in cross-section, so that the insertion degree of the fixing pin 8 can be increased thereby making it possible to extensively bend the wire string and to withstand a large load. Other constructions are the same as those of the previous embodiment.

On the other hand, the fixing pin 8 to be fitted into the fastening hole 6 comprises as shown in FIG. 3(*c*) a main body 8*a* having a diameter slightly smaller than that of the fastening hole 6, and a pressing portion 8*b* having a diameter smaller than that of the main body 8*a*. This fixing pin 8 is also provided at an intermediate portion of the main body 8*a* with a projected portion 9 extending slightly larger than the cross-section of the fastening hole 6.

In this embodiment, this projected portion 9 is formed of an annular projection extending along the outer circumferential wall of the main body 8*a*.

The position of this projected portion 9 may be such that it can be inserted near the opening of the fastening hole 6 when the tip portion of the fixing pin 8 is not yet introduced into the through-passage 5 (see FIG. 4), and it is kept remained within the fastening hole 6 as the wire string 2 is press-held by a tip portion of the fixing pin 8 (see FIG. 4).

This accessories 1 constructed in this manner can be assembled as follows.

First of all, the wire string 2 pierced through a plurality of the decorative bodies 3. On the other hand, the fixing pin 8 is inserted into the fastening hole 6 of the wire string fastener 4. In this occasion, the fixing pin 8 is inserted into the fastening hole 6 to such an extent that the projected portion 9 is fitted in near the opening of the fastening hole 6. With the fixing pin 8 inserted into the fastening hole 6 in this manner, the fixing pin 8 can be secured by the fastening hole 6, while keeping the tip portion of the fixing pin 8 away from being introduced into the through-passage 5 (see FIG. 4).

Then, each end portion of the wire string 2 is first passed through the through-passage 5 of the wire string fastener 4, and then passed through the string-passing ring 11 linked to the clasp 10. The end portion of the wire string 2 thus passed through the string-passing ring 11 is then turned back and inserted into the through-passage 5 of the wire string fastener 4 in a direction opposite to the previous one. After adjusting the length of the wire string 2, the fixing pin 8 is further pushed into the fastening hole 6 thereby pressing the wire string 2 inserted back and forth in dual in the through-passage 5. In this operation, the projected portion 9 is also further pushed into the fastening hole 6.

Since the fixing pin 8 to be fitted into the fastening hole 6 is provided with the projection 9 extending slightly larger than the cross-section of the fastening hole 6, the fixing pin 8 advances through the fastening hole 6 with its projection 9 pressing against the inner wall of the fastening hole 6 and being partially collapsed, so that any space left between the inner wall of fastening hole 6 and the fixing pin 8 is vanished, thus increasing the attaching strength.

At the same time, since the pressing portion **8*b* of the fixing pin 8 pushes the wire string 2 towards the depression 7, the wire string 2 is caused to bend along the shape of the depression 7 in the shape of V, and secured in that bent state by the fixing pin 8 (see, FIG. 2**).

With this fastening system, it is possible to increase the tensile strength against the wire string 2, even if the pressing strength of the pressing portion **8*b* of the fixing pin 8 is smaller than the pressing power of a screw and the like, since the wire string 2** is secured in a bent state.

In the above embodiment, the diameter of the pressing portion **8*b* of the fixing pin 8 is made smaller for facilitating the insertion thereof into the fastening hole 6. However, the lower portion of the fixing pin 8, which constitutes a pressing portion may be the same in diameter as the main body of the fixing pin 8 as shown in FIG. 3**(*b*). In this case, it is desired that the peripheral portion of the tip of the fixing pin 8 is beveled into a taper-like shape so as to make easy the insertion of the fixing pin 8.

Figure 5:
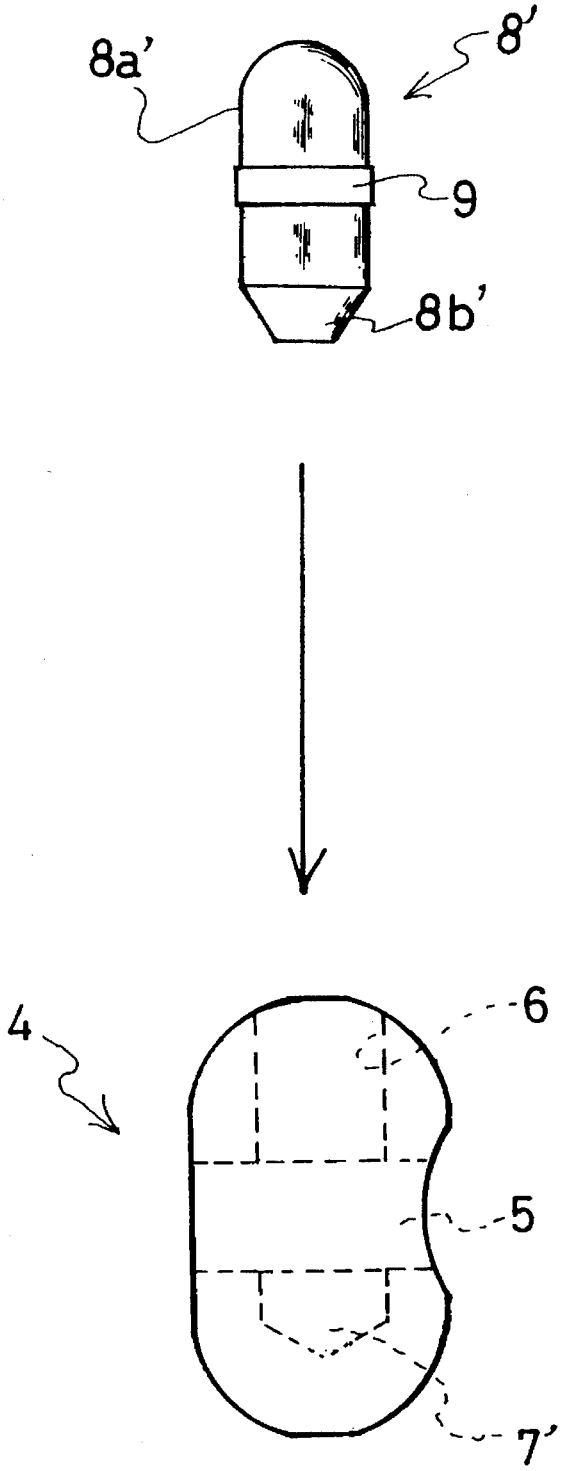
FIG. 5 is a side view of a wire string fastener and a fixing pin according to another example.

The wire string fastener 4 shown in FIG. 5 is an example of a miniaturized fastener wherein the depression 7 is deeply formed as in the embodiment of FIG. 4.

The fixing pin 8 is of frusto-conical shape wherein the pressing portion **8*b* is taper-shaped, the diameter thereof being gradually narrowed as compared with the main portion 8*a*, thereby making it easy to insert into the depression 7**.

Figure 6:
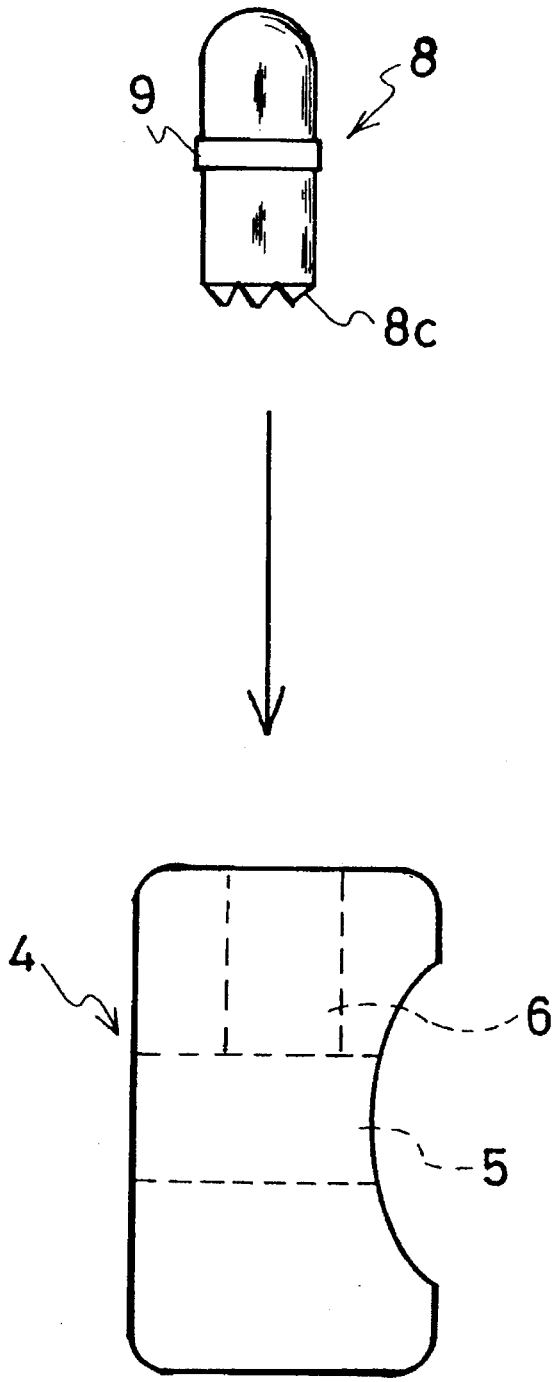
FIG. 6 is a side view of a wire string fastener according to still another example.

The wire string fastener 4 shown in FIG. 6 is of the same structure as those of the previous embodiment except that it is dispensed with the depression. The fixing pin 8 is provided at the middle portion with a projection 9, and also with teeth portion **8*c*** on the distal end portion of the pressing portion.

Other structures which are the same as those of the previous embodiments will be referred to by putting the same reference numerals as those used in the previous embodiments thereby omitting the explanation thereof.

In this case, the teeth portion **8*c* of the fixing pin 8 functions to strongly secure the wire string. This teeth portion 8*c*** may not be sharp at tip portion, but may be of reverse-trapezoidal shape, or of projected or rugged shape having one or more grooves formed therein.

Further, the pressing portion of the fixing pin may be flat without forming teeth portion, the wire string being directly press-secured by the flat pressing portion.

Figure 7:
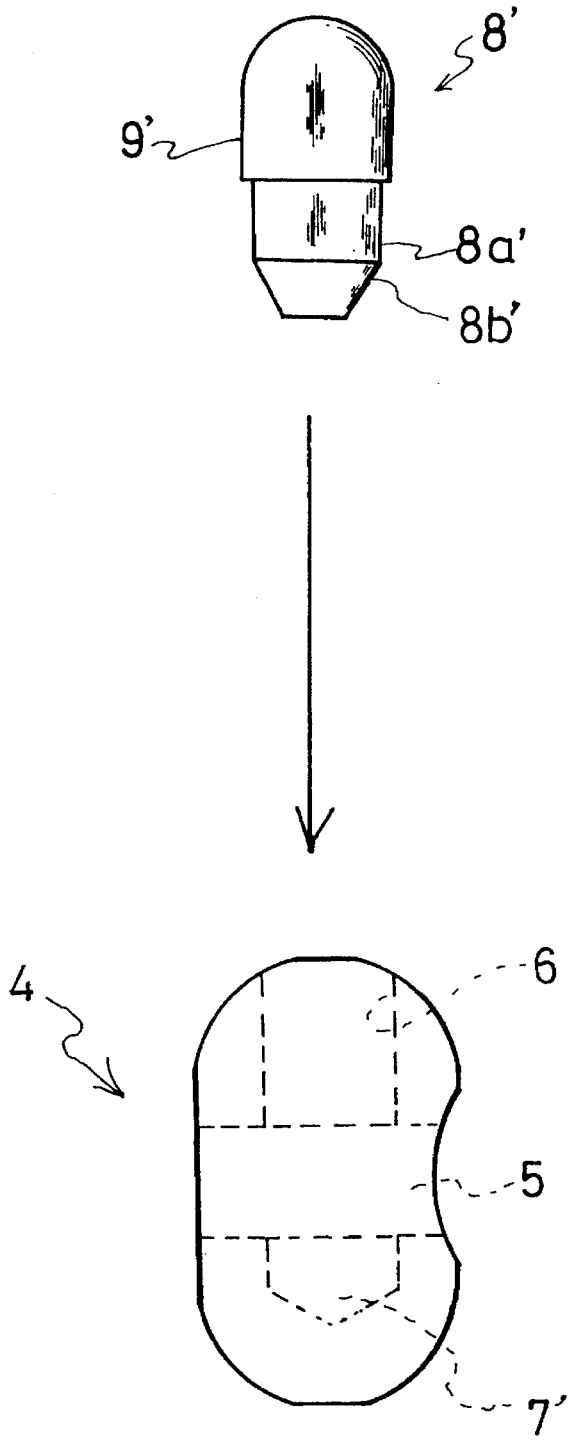
FIG. 7 is a side view of a fixing pin according to another example.

FIG. 7 illustrates another embodiment wherein the upper portion of the fixing pin 8 is made larger in diameter than the fastening hole 6, this upper portion functioning as a projection 9.

The portion lower than the projection 9 of the fixing pin 8 is made slightly smaller in diameter than the fastening hole 6 forming a main axial body **8*a* and a frustum-conical pressing portion 8*b***.

As in the case of previous embodiments, a portion of the projected portion 9 is partially inserted near the opening of the fastening hole 6, while keeping the pressing portion **8*b* of the fixing pin 8 from being introduced into the through-passage 5 as the fixing pin 8 is put into the fastening hole 6, and it is kept firmly remained therein. When the fixing pin 8 is further pushed therein, the tip portion of the fixing pin 8 traverses through the through-passage 5 and presses the wire string 2 with the main portion of the projection 9** being press-held thereby enhancing the attaching strength.

Figure 8:
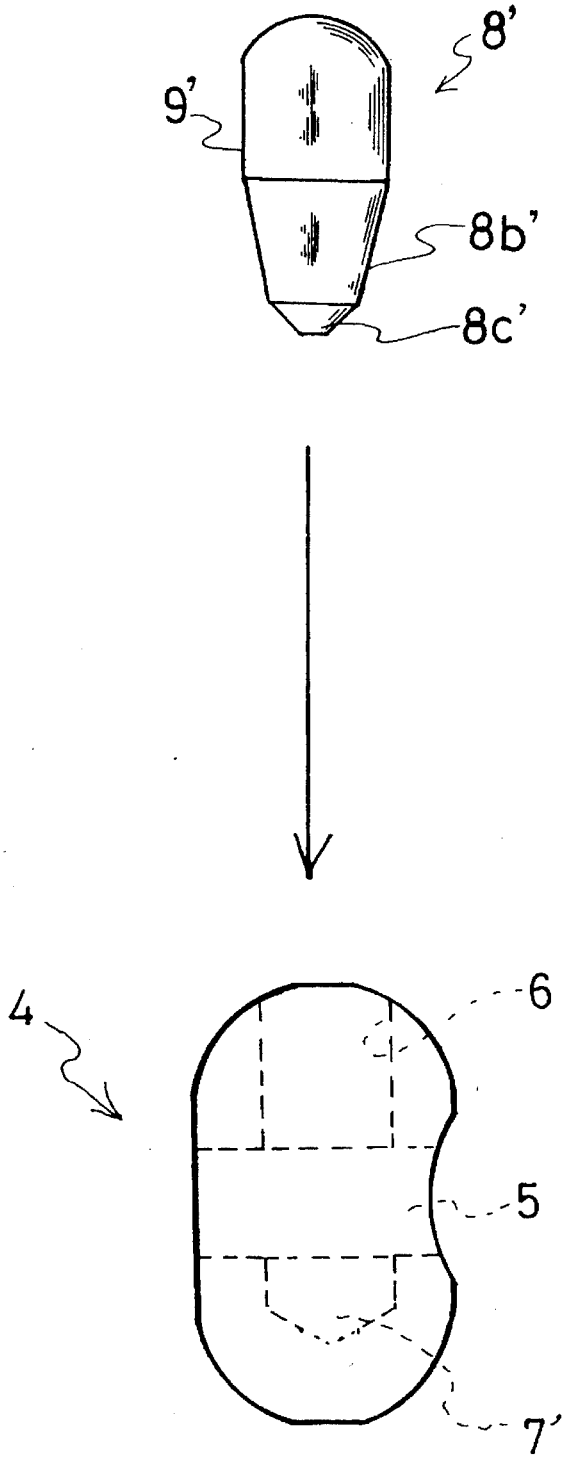
FIG. 8 is a side view of a fixing pin according to still another example.

The fixing pin 8 shown in FIG. 8 has a projection 9 which has a larger diameter than the fastening hole 6. The portion lower than the projection 9 of the fixing pin 8 is made slightly smaller in diameter than the fastening hole 6 forming a tapered pressing portion **8*b* and a still smaller teeth portion 8*c*** formed at its tip portion.

This teeth portion **8*c* may be omitted, leaving only the projection 9 and the tapered pressing portion 8*b***.

Since the tapered pressing portion **8*b* and the upper projection 9 are interconnected each other as in the case of previous embodiment, the insertion thereof into the fastening hole 6** would be easily performed.

If a depression 7 is formed in the wire string fastener 4 as shown in FIGS. 7 and 8, it would be desirable in enhancing the fastening strength. However, the provision of such depression is not essential in this invention.

When tests were conducted based on JIS Z 2241 (tensile strength test for metallic material) using the structure shown in FIG. 2 under the conditions of; 1 mm in diameter of fastening hole, 0.95 mm in diameter of fixing pin; 2.2 mm in length of fixing pin; 1.04 to 1.07 mm in diameter of projection; and 0.2 to 0.3 in width of projection, it was confirmed that the structure could withstand the load of over 6 kg.

It would be possible to further increase the withstanding strength if a structure of deep depression 7 as shown in FIGS. 4, 5, 7 and 8 is adopted.

It was also confirmed that even if the depression is omitted and wire string is to be pressed only through the fixing pin, it is also capable of withstanding ordinary load as required in accessories though it is incapable of withstanding such a high load as mentioned above. It is further confirmed that if teeth portion is formed on the pressing portion of the fixing pin, load-withstanding strength would be further improved.

According to this invention, the decorative bodies are not confined to beads, but may be various materials as far as they can be linked with a wire string and useful as an accessories.

The projection is not confined to a rib-like shape, but may be a series of spherical projection or any other projected shapes. It is preferable that the lower portion of the projection is tapered for facilitating the insertion thereof into the fastening hole.

The depression may be of any shape as long as it is capable of bending a portion of wire string.

The position of the projection to be formed on the fixing pin may be any place as long as it can be remained within the fastening hole when a wire string is fixed by the fixing pin. Therefore, even if it is disposed at a place not engaging with the opening of fastening hole when the tip portion of the fixing pin is just introduced into the through-passage. Because, even if the projection is disposed in such position, it is possible to firmly fasten the wire string with the fixing pin. Therefore, the projection may be provided at an upper portion of the fixing pin.

It is also possible to form a small supplementary hole opening to the bottom of the wire string fastener in such a manner that the supplementary hole is coaxial with the fastening hole and communicating with the through-passage (if a depression is formed, the depression). This supplementary hole can be used to allow a pin to pass therethrough to push up the fixing pin caulked therein to remove therefrom, thus withdrawing the fixing pin.

It should be noted that other modifications are possible within the scope claimed in claims.

It is possible according to this invention to firmly fix a wire string by simply fitting a fixing pin provided with a projection into the fastening hole of a wire string fastener, the projection being strongly fitted in the fastening hole while being partially collapsed.

The fixing of wire string can be easily performed, if the tip portion of the fixing pin can be kept secured before the fixing pin is further inserted into the through-passage thereby allowing the passing of a wire string through the through-passage, the fixing pin being subsequently strongly inserted into the through-passage to firmly fix the wire string.

If a depression is formed in the inner wall of the through-passage of the wire string fastener for fixing a wire string in a bent state, a strong fixing strength can be attained even if the pressing area is small. Therefore, it is possible to miniaturize the wire string fastener and wire string fixing portion without weakening the fixing strength. Further, since the fixing pin is merely provided with a collapsible projection, the fastening hole can also be minimized.

I claim:

1. An accessories wherein a series of decorative bodies are coupled one after another by means of wire string, each end of the wire string is passed through a through-passage formed in a wire string fastener and through a turn-back portion of clasp, the end of the wire string thus passed through is then turned back to be again passed through the through-passage where said each of the wire string is fixed by means of a fixing means, which is characterized in that;

each of said wire string fasteners is provided with a fastening hole, one end of which being communicated with said through-passage and the other end of which being open to outside;

said fixing means is formed of fixing pin which can be fittingly inserted into said fastening hole; and said fixing pin is provided on its peripheral wall portion with a collapsible projected portion extending slightly larger than the inner diameter of said fastening hole, said projected portion being disposed at such a location on said fixing pin that said projected portion can be press-contacted with the vicinity of the opening portion of the fastening hole so as to be held by said opening of the fastening hole before the tip portion of the fixing pin is introduced into said through-passage and that said projected portion can be collapsed and frictionally held by the inner wall of said fastening hole when said tip portion of said fixing pin is further inserted into said through-passage.

2. The accessories according to claim 1, wherein said fastening hole is circular in cross-section, and said fixing pin is cylindrical, and said projection is coaxial and has larger diameter than other portions of the fixing pin.

3. The accessories according to claim 2, wherein said projection is band-like formed along the outer circumference of a middle portion of the fixing pin.

4. The accessories according to claim 2, wherein said fixing pin comprises an upper half portion constituting said projection and a lower half portion tapered in the direction of lower end thereof.

5. An accessory wherein a series of decorative bodies are coupled one after another by means of a wire string, each end of the wire string being passed through a through-passage formed in a wire string fastener and through a turn-back portion of a clasp, the end of the wire string thus passed through is turned back to be again passed through the through-passage where each end of the wire string is fixed by means of a fixing means which is characterized in that:

each of said wire string fasteners is provided with a fastening hole having substantially a smooth inner wall, one end of which is in communication with said through-passage and the other end of which is open to the outside, and with a depression which is open to said through-passage and disposed to actually coincide with said fastening hole;

said fixing means comprising a fixing pin which can be fittingly inserted into said fastening hole; and said fixing pin being provided on its peripheral wall portion with a collapsible projected portion extending slightly larger than the inner diameter of said fastening hole and at the lower end of which is provided with a pressing portion having a size to be engaged with the opening of said depression, said projected portion being disposed at such a location on said fixing pin such that said projected portion can be press-contacted with the vicinity of the opening portion of the fastening hole so as to be held by said opening portion of said fastening hole before the tip portion of said fixing pin is introduced into said through-passage, said projected portion being collapsible and to be frictionally held by the inner wall of said fastening hole when the tip portion of said fixing pin is further inserted into said through-passage to press-hold said wire string.

6. The accessories according to claim 5, wherein said fastening hole is circular in cross-section, and said fixing pin is cylindrical, and said projection is coaxial and has larger diameter than other portions of the fixing pin.

7. The accessories according to claim 6, wherein said projection is band-like formed along the outer circumference of a middle portion of the fixing pin.

8. The accessories according to claim 6, wherein said fixing pin comprises an upper half portion constituting said projection and a lower half portion tapered in the direction of lower end thereof.

* * * * *